US010695895B2

(12) United States Patent
Tudor et al.

(10) Patent No.: US 10,695,895 B2
(45) Date of Patent: Jun. 30, 2020

(54) SOCKET TOOL ADAPTER

(71) Applicant: Nissan North America, Inc., Franklin, TN (US)

(72) Inventors: Brent Tudor, Smyrna, TN (US); Joseph Aquino, Smyrna, TN (US)

(73) Assignee: Nissan North America, Inc., Franklin, TN (US)

( * ) Notice: Subject to any disclaimer, the term of this patent is extended or adjusted under 35 U.S.C. 154(b) by 181 days.

(21) Appl. No.: 16/024,082

(22) Filed: Jun. 29, 2018

(65) Prior Publication Data

US 2020/0001439 A1 Jan. 2, 2020

(51) Int. Cl.
*B25B 13/50* (2006.01)

(52) U.S. Cl.
CPC ..... *B25B 13/5008* (2013.01)

(58) Field of Classification Search
CPC ..... B25B 13/5008; B25B 13/44; B25B 13/18; B25B 13/00; B25B 13/32
See application file for complete search history.

(56) References Cited

U.S. PATENT DOCUMENTS

| | | | | | |
|---|---|---|---|---|---|
| 599,837 | A * | 3/1898 | Harris | B25B 13/32 | 81/90.3 |
| 877,773 | A * | 1/1908 | Holm | B25B 13/44 | 81/128 |
| 912,117 | A * | 2/1909 | Green | B25B 15/04 | 81/58.4 |
| 3,664,213 | A * | 5/1972 | Anati | B25B 13/46 | 81/90.2 |
| 4,909,180 | A | 3/1990 | Oishi et al. | | |
| 5,947,377 | A | 9/1999 | Hansinger et al. | | |

* cited by examiner

*Primary Examiner* — David B. Thomas
(74) *Attorney, Agent, or Firm* — Global IP Counselors, LLP

(57) ABSTRACT

A socket tool adapter includes a base member having a first surface and a second surface. First and second jaw members are pivotally connected to the first surface of the base member. The first and second jaw members are configured to move between first and second closed positions and first and second open positions, respectively. The first and second jaw members are configured to receive an accessory when the first and second jaw members are in the open positions. First and second biasing members are connected between the first and second jaw members, respectively, and the base member. The first and second biasing members are configured to bias the first and second jaw members to the first and second closed positions, respectively. A cover member is connected to the second surface of the base member.

20 Claims, 5 Drawing Sheets

SOCKET TOOL ADAPTER

BACKGROUND

Field of the Invention

The present invention generally relates to a socket tool adapter. More specifically, the present invention relates to a socket tool adapter configured to receive bell cups of various sizes and to properly and efficiently install a received bell cup.

Background Information

Bell cups are used in high volume paint application environments. The bell cup applies the supplied paint to the object being painted, such as an automobile. Currently, no standard exists for installation of the bell cup such that installation of a bell cup frequently results in over-tightening. An over-tightened bell cup is difficult to remove, which can result in damage to the bell cup so that it cannot be reused, such as the threads being stripped. Bell cups are expensive components of an automobile painting process line such that frequently destroying a bell cup due to poor or improper installation results in high replacement expenses. Accordingly, a need exists for a socket tool adapter configured to receive bell cups of various sizes and to properly and efficiently install a received bell cup, thereby reducing costs associated with replacing bell cups destroyed by poor or improper installation.

SUMMARY

An object of the disclosure is to provide a socket tool adapter configured to receive bell cups of various sizes and to properly and efficiently install a received bell cup.

In view of the state of the known technology, one aspect of the present disclosure is to provide a socket tool adapter including a base member having a first surface and a second surface. A first jaw member is pivotally connected to the first surface of the base member. The first jaw member is configured to move between a first closed position and a first open position. A second jaw member is pivotally connected to the first surface of the base member. The second jaw member is configured to move between a second closed position and a second open position. The first and second jaw members are configured to receive an accessory when the first and second jaw members are in the open positions. A first biasing member is connected between the first jaw member and the base member. The first biasing member is configured to bias the first jaw member to the first closed position. A second biasing member is connected between the second jaw member and the base member. The second biasing member is configured to bias the second jaw member to the second closed position. A cover member is connected to the second surface of the base member.

Another aspect of the present invention includes a socket tool adapter including a base member having a first surface and a second surface. A tool receiving opening disposed in the base member is configured to receive a tool. A first jaw member is pivotally connected to the first surface of the base member. The first jaw member is configured to move between a first closed position and a first open position. First and second gripping members extend outwardly from the first jaw member. A second jaw member is pivotally connected to the first surface of the base member. The second jaw member is configured to move between a second closed position and a second open position. Third and fourth gripping members extend outwardly from the second jaw member. A first biasing member is connected between the first jaw member and the base member. The first biasing member is configured to bias the first jaw member to the first closed position. A second biasing member is connected between the second jaw member and the base member. The second biasing member is configured to bias the second jaw member to the second closed position. A cover member is connected to the second surface of the base member. The first and third gripping members form a first gripping portion configured to receive a first accessory when the first and second jaw members are moved to the first and second open positions, respectively. The second and fourth gripping members form a second gripping portion configured to receive a second accessory when the first and second jaw members are in a position between the first and second closed positions and the first and second open positions, respectively.

Also other objects, features, aspects and advantages of the disclosed socket tool adapter will become apparent to those skilled in the art from the following detailed description, which, taken in conjunction with the annexed drawings, discloses exemplary embodiments of the vehicle body structure.

BRIEF DESCRIPTION OF THE DRAWINGS

Referring now to the attached drawings which form a part of this original disclosure.

DETAILED DESCRIPTION OF EXEMPLARY EMBODIMENTS

Selected embodiments will now be explained with reference to the drawings. It will be apparent to those skilled in the art from this disclosure that the following descriptions of the embodiments are provided for illustration only and not for the purpose of limiting the invention as defined by the appended claims and their equivalents.

Figure 1:
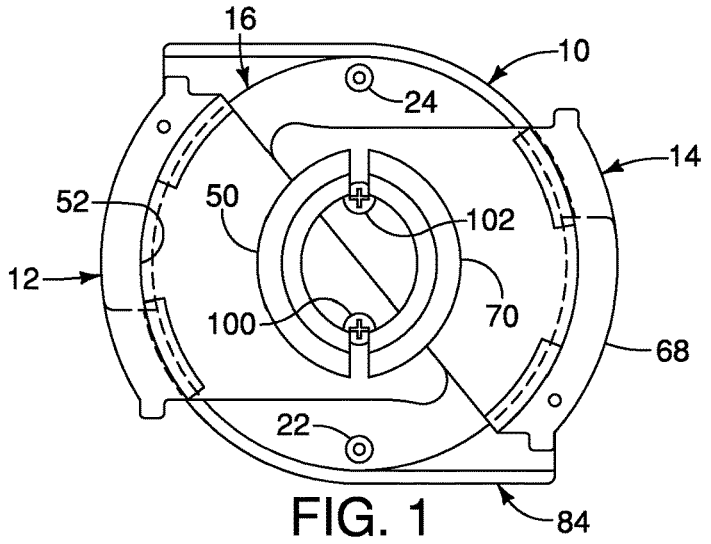
FIG. 1 is a top plan view of a socket tool adapter in accordance with an exemplary embodiment of the present invention.
Figure 2:
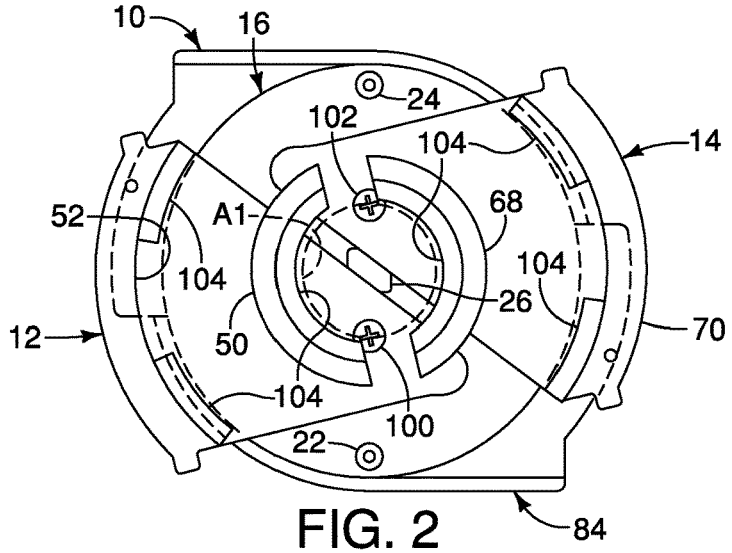
FIG. 2 is a top plan view of the socket tool adapter of FIG. 1 in which first and second jaw members are opened to a first position.
Figure 3:
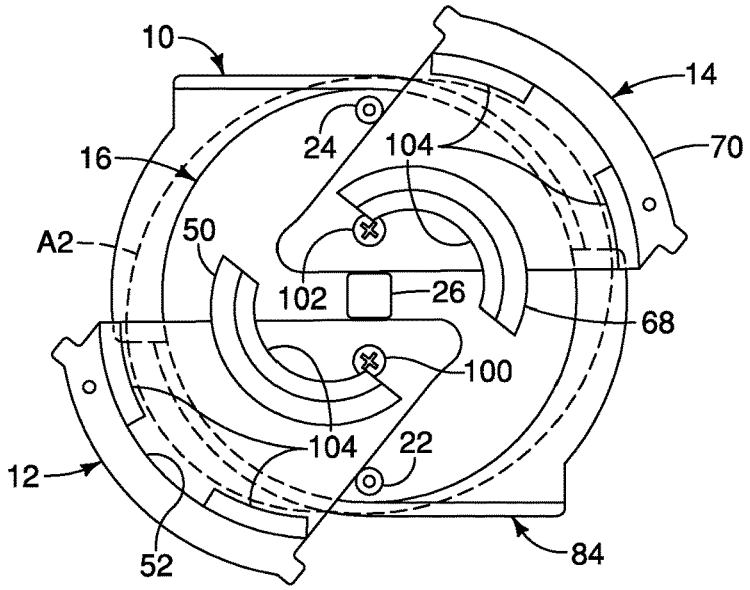
FIG. 3 is a top plan view of the socket tool adapter of FIG. 1 in which the first and second jaw members are opened to a second position.

Referring initially to FIGS. 1-3, a socket tool adapter 10 is illustrated in accordance with an exemplary embodiment of the present invention. The socket tool adapter 10 includes first and second jaw members 12 and 14 pivotally connected to a base member 16. The first and second jaw members 12 and 14 are opened to a first position, as shown in FIG. 2, to receive a first accessory A1, such as a 30 mm bell cup. The first and second jaw members 12 and 14 are opened to a second position, as shown in FIG. 3, to receive a second accessory A2, such as an 80 mm bell cup. The first and second accessories A1 and A2 are different sizes. The socket tool adapter 10 can then be used to properly and efficiently install the received accessory.

Figure 4:
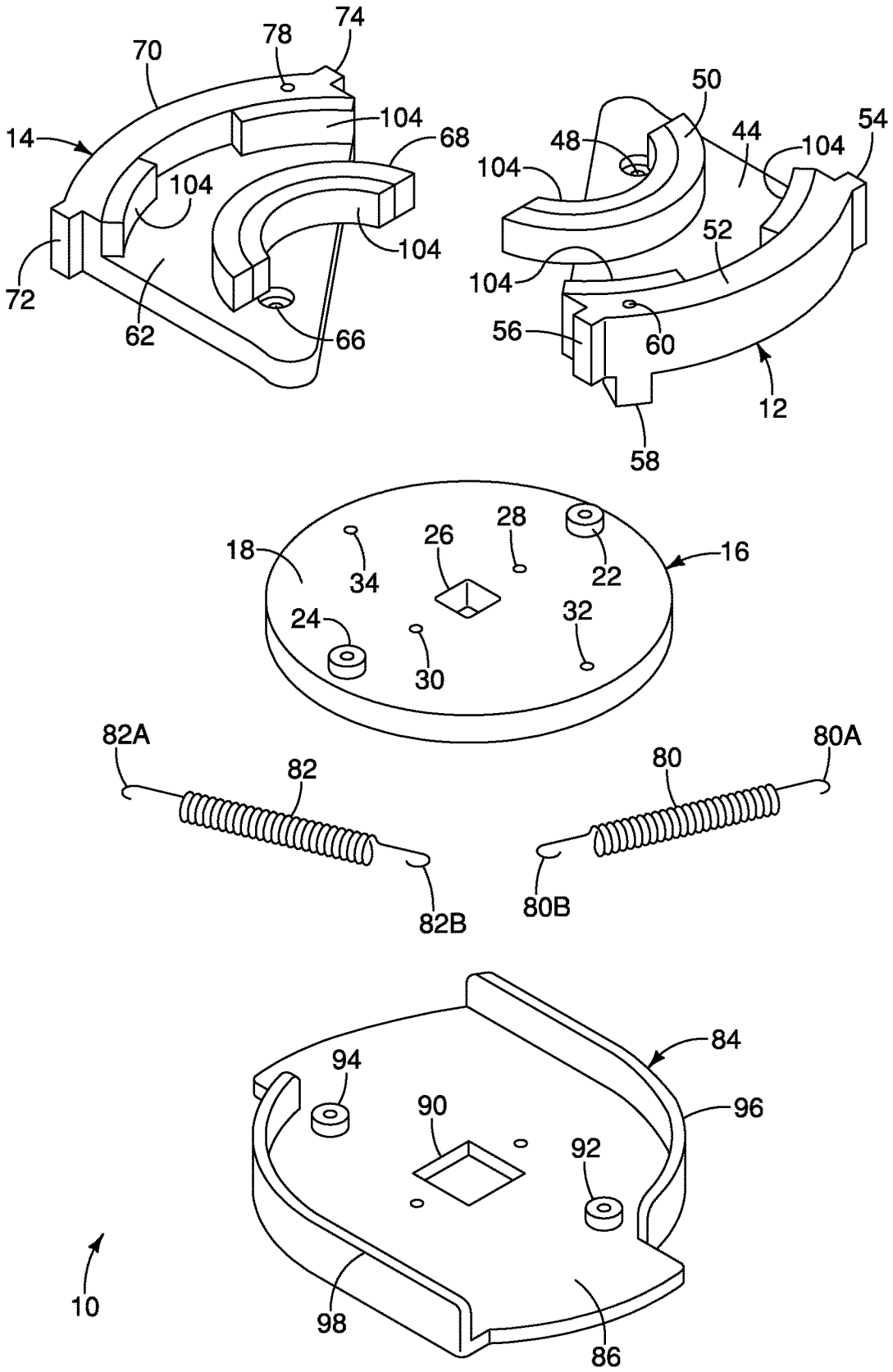
FIG. 4 is a top exploded assembly view of the socket tool adapter of FIG. 1.
Figure 5:
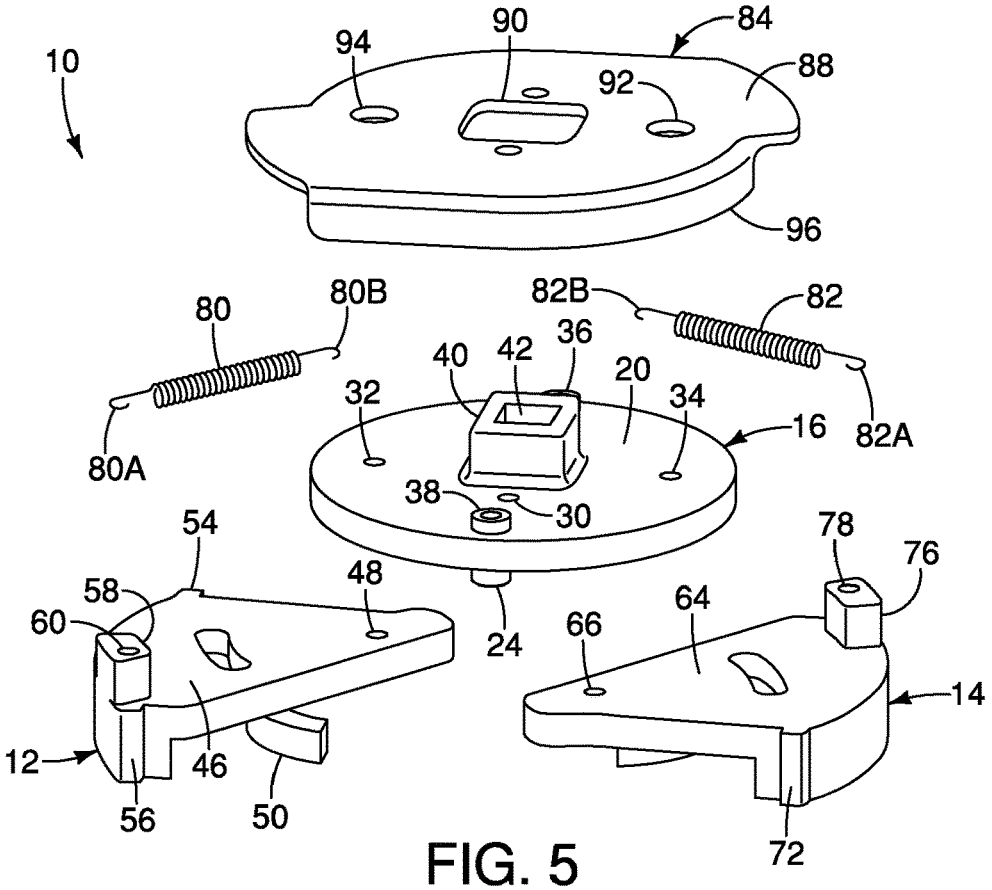
FIG. 5 is a bottom exploded assembly view of the socket tool adapter of FIG. 1.

As shown in FIGS. 4 and 5, a base member 16 of the socket tool adapter 10 has a first, or upper, surface 18 and a second, or lower, surface 20. The base member 16 can have any suitable shape. Preferably, the base member 16 is substantially circular. The second surface 20 faces in an opposite direction from the first surface 18. The base member 16 can be made of any suitable material, such as a plastic polymer or a metal. Preferably, the base member 16 is integrally formed as a one-piece member.

First and second fastener receiving posts 22 and 24 extend outwardly from the first surface 18 of the base member, as shown in FIG. 4. Each of the first and second fastener receiving posts 22 and 24 has an opening to receive a fastener. A tool receiving opening 26 extends through the base member 16 from the first surface 18 to the second surface 20. Preferably, the tool receiving opening 26 is located in the center of the base member 16. A first fastener hole 28 is disposed between the first fastener receiving post 22 and the tool receiving opening 26. A second fastener hole 30 is disposed between the second fastener receiving post 24 and the tool receiving opening 26. A third fastener hole 32 is disposed between the tool receiving opening 26 and an outer perimeter of the base member 16. A fourth fastener hole 34 is disposed between the tool receiving opening 26 and the outer perimeter of the base member 16. Preferably, the tool receiving opening 26 is disposed between the third and fourth fastener holes 32 and 34. Each of the first, second, third and fourth fastener holes 28, 30, 32 and 34 extend from the first surface 18 to the second surface 20. Preferably, a line passing through the first and second fastener holes 28 and 30 is substantially perpendicular to a line passing through the third and fourth fastener holes 32 and 34, as shown in FIG. 4.

Third and fourth fastener receiving posts 36 and 38 extend outwardly from the second surface 20 of the base member 16, as shown in FIG. 5. Each of the third and fourth fastener receiving posts 36 and 38 has an opening to receive a fastener. The third fastener receiving post 36 preferably extends in an opposite direction from the first fastener receiving post 22. The fourth fastener receiving post 38 preferably extends in an opposite direction from the second fastener receiving post 24. A tool receiving projection 40 extends outwardly from the second surface 20 and has a shape corresponding to the tool receiving opening 26. A bore 42 extends through the tool receiving projection to provide access to the tool receiving opening 26.

Referring to FIGS. 3-6, the first jaw member 12 is pivotally connected to the first surface 18 of the base member 16. The first jaw member 12 has a first, or upper, surface 44 and a second, or lower, surface 46. A first fastener hole 48 extends from the first surface 44 to the second surface 46. Preferably, as shown in FIG. 4, the first fastener hole 48 is countersunk on the first surface 46. A first gripping member 50 extends outwardly from the first surface 44. A portion of the first gripping member 50 extends beyond an edge of the first surface 44. A second gripping member 52 extends outwardly from the first surface 44. Preferably, the second gripping member 52 is disposed at an outer edge of the first jaw member 12. The first and second gripping members 50 and 52 preferably have arcuate shapes. Gripping tabs 54 and 56 are disposed at opposite ends of the second gripping member 52 to facilitate manipulation of the first jaw member 12, and extend outwardly from the second gripping member 52.

A first projection 58 extends downwardly from the second surface 46 of the first jaw member 12, as shown in FIG. 5. Preferably, the first projection 58 is disposed at the outer edge of the first jaw member 12. A second fastener hole 60 extends from the first projection 58 to the second gripping member 52.

Figure 7:
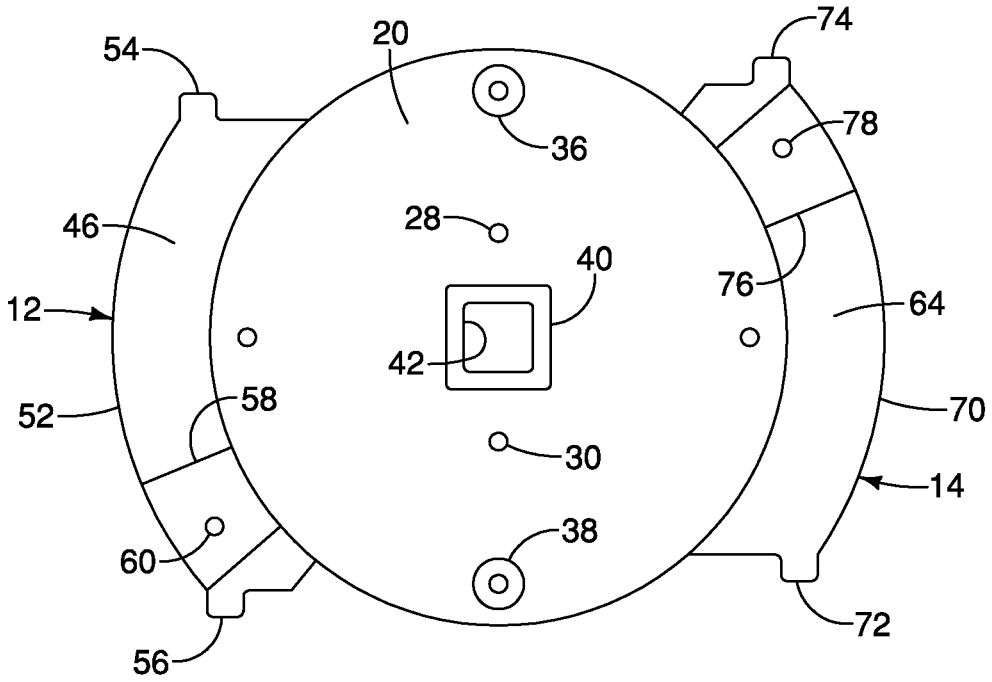
FIG. 7 is a bottom plan view of a partially assembled socket tool adapter of FIG. 6 in which the first and second jaw members are connected to the base member.

Referring to FIGS. 3 and 7, the second jaw member 14 is pivotally connected to the second surface 20 of the base member 16. The second jaw member 14 has a first, or upper, surface 62 and a second, or lower, surface 64. A first fastener hole 66 extends from the first surface 62 to the second surface 64. Preferably, as shown in FIG. 4, the first fastener hole 66 is countersunk on the first surface 62. A third gripping member 68 extends outwardly from the first surface 62. A portion of the third gripping member 68 extends beyond an edge of the first surface 62. A fourth gripping member 70 extends outwardly from the first surface 62. Preferably, the fourth gripping member 70 is disposed at an outer edge of the second jaw member 14. The third and fourth gripping members 68 and 70 preferably have arcuate shapes. Gripping tabs 72 and 74 are disposed at opposite ends of the fourth gripping member 70 to facilitate manipulation of the second jaw member 14, and extend outwardly from the fourth gripping member 70.

A second projection 76 extends downwardly from the second surface 64 of the second jaw member 14, as shown in FIG. 5. Preferably, the second projection 76 is disposed at the outer edge of the second jaw member 14. A second fastener hole 78 extends from the second projection 76 to the fourth gripping member 70.

The first and second jaw members 12 and 14 are preferably substantially identical, as shown in FIGS. 4 and 5. The first and second jaw members 12 and 14 can be made of any suitable material, such as a plastic polymer or a metal. Preferably, each of the first and second jaw members 12 and 14 is integrally formed as a one-piece member.

Figure 8:
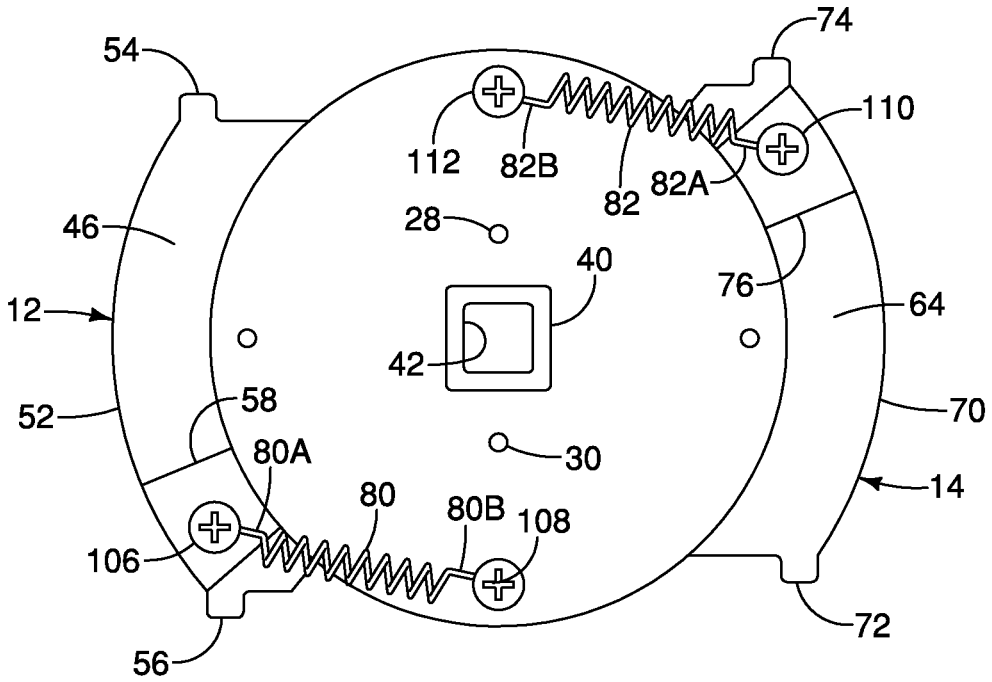
FIG. 8 is a bottom plan view of the partially assembled socket tool adapter of FIG. 7 in which first and second biasing members are connected to the first and second jaw members, respectively, and to the base member.

Referring to FIG. 8, a first biasing member 80 is connected between the first jaw member 12 and the base member 16. As shown in FIG. 8, a first end 80A of the first biasing member 80 is connected to the first projection 58 of the first jaw member 12. A second end 80B of the first biasing member is connected to the base member 16. The first biasing member 80 is configured to bias the first jaw member 12 to the first closed position. The first biasing member 80 is preferably a helical spring, although any suitable biasing member can be used.

Referring to FIG. 8, a second biasing member 82 is connected between the second jaw member 14 and the base member 16. As shown in FIG. 8, a first end 82A of the second biasing member 82 is connected to the second projection 58 of the second jaw member 14. A second end 82B of the second biasing member 82 is connected to the base member 16. The second biasing member 82 is configured to bias the second jaw member 14 to the second closed position. The second biasing member 82 is preferably a helical spring, although any suitable biasing member can be used.

Figure 10:
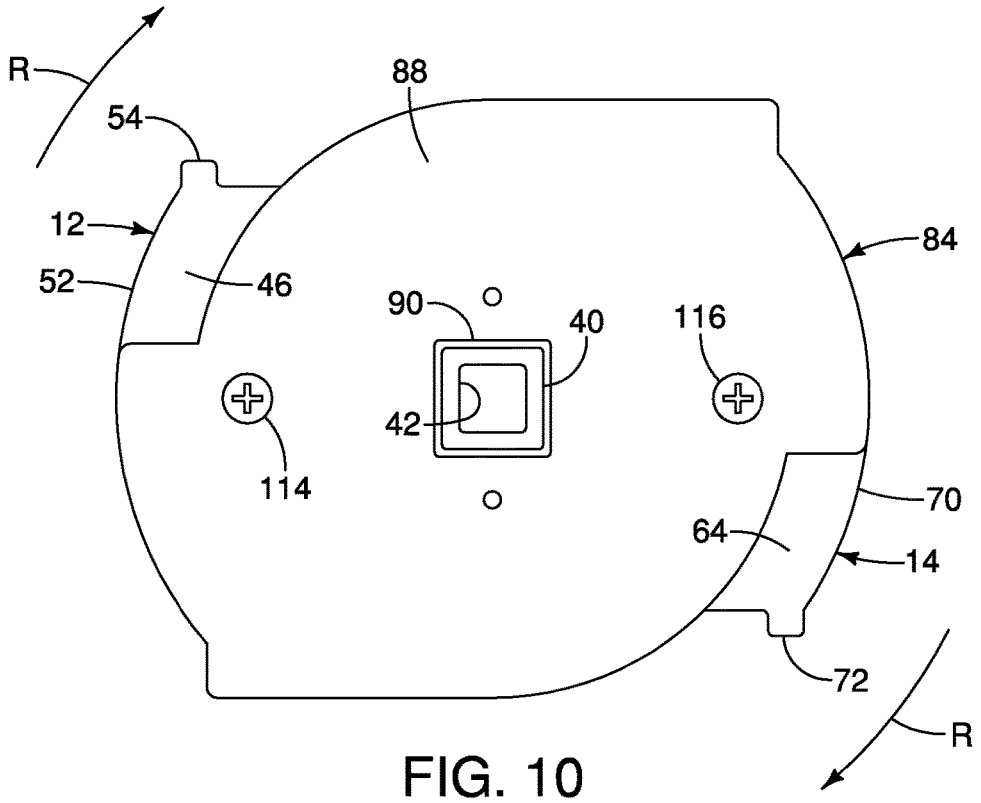
FIG. 10 is a bottom plan view of the socket tool adapter of FIG. 1.

A cover member 84 is connected to the second surface 20 of the base member 16, as shown in FIGS. 4, 5 and 10. The cover member 84 has a first, or upper, surface 86 and a second, or lower, surface 88. A tool receiving opening disposed in the base member is configured to receive a tool, such as a split torque wrench. The cover member 84 can be made of any suitable material, such as a plastic polymer or a metal. Preferably, the cover member 84 is integrally formed as a one-piece member.

A tool receiving opening 90 extends from the first surface 86 to the second surface 88, as shown in FIGS. 4 and 5. First and second fastener receiving posts 90 and 92 are disposed on opposite sides of the tool receiving opening 90. First and second guide walls 96 and 98 extend outwardly from the first surface 86 of the cover member 84. The first guide wall 96 is disposed on an opposite side of the tool receiving opening 90 from the second guide wall 98.

Figure 6:
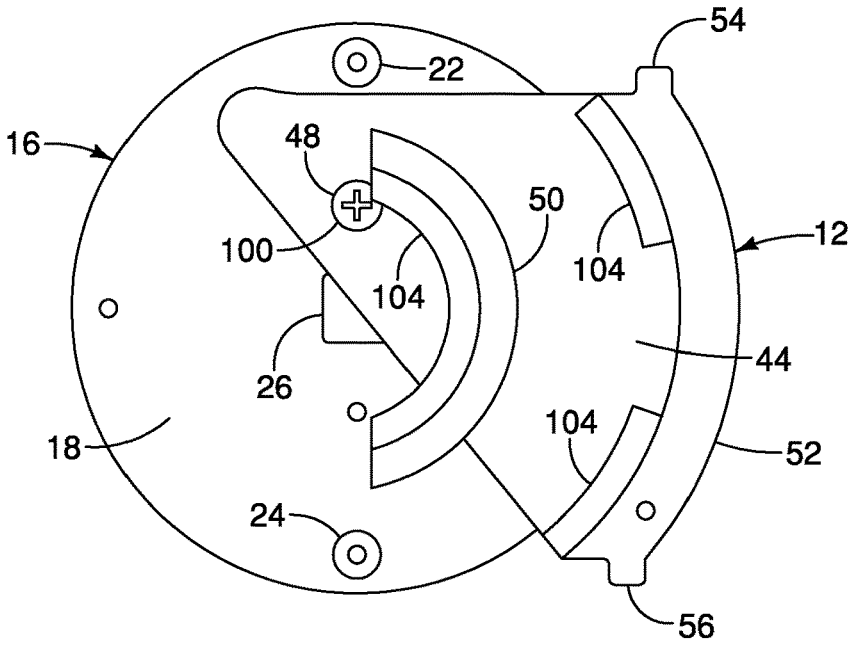
FIG. 6 is a top plan view a partially assembled socket tool adapter of FIG. 1 in which the first jaw member is connected to a base member.

Assembly of the socket tool adapter 10 is shown in FIGS. 6-10. As shown in FIG. 6, the first jaw member 12 is disposed on the first surface 18 of the base member 16 such that the first fastener hole 48 of the first jaw member 12 is aligned with the first fastener hole 28 of the base member 16. A fastener 100 is inserted in the first fastener holes 48 and 28 of the first jaw member 12 and the base member 16, respectively, to pivotally connect the first jaw member 12 to the base member 16. The second jaw member 14 is disposed on the first surface 18 of the base member 16 such that the first fastener hole 66 of the second jaw member 14 is aligned with the second fastener hole 30 of the base member 16. A fastener 102 (FIGS. 1-3) is inserted in the first fastener hole 66 of the second jaw member 14 and the second fastener hole 30 of the base member 16 to pivotally connect the second jaw member 14 to the base member 16. The fastener holes 48 and 66 in the first and second jaw members 12 and 14 are preferably countersunk to avoid interfering with the received accessory.

As shown in FIGS. 1-4 and 6, a gripping pad 104 is attached to each of the gripping members 50, 52, 68 and 70. The gripping pad 104 is disposed on an inner surface of each of the gripping member 50, 52, 68 and 70 with respect to the tool receiving opening 26. The gripping pads 104 facilitate receiving the accessory, such as a bell cup, such that the accessory can be securely retained by the socket tool adapter 10 and installed without marring or otherwise damaging the accessory. The gripping pads 104 can be a single member, such as with respect to the first and third gripping members 50 and 68. Alternatively, the gripping pads 104 can be a plurality of gripping pads 104 disposed on the inner surfaces of the gripping members, such as shown with respect to the second and fourth gripping members 52 and 70. Preferably, the gripping pads 104 are made of rubber.

The base member 16 is then turned over, as shown in FIG. 7, such that the first and second biasing members 80 and 82 can be attached. As shown in FIG. 8, the first biasing member 80 is connected between the first jaw member 12 and the base member 16. A fastener 106 is received by the second fastener hole 60 in the first projection 58 of the first jaw member 12 to secure a first end 80A of the first biasing member 80 to the first jaw member 12. A fastener 108 is received by the third fastener receiving post 36 of the base member 16 to secure the second end 80B of the first biasing member 80 to the base member 16.

Figure 9:
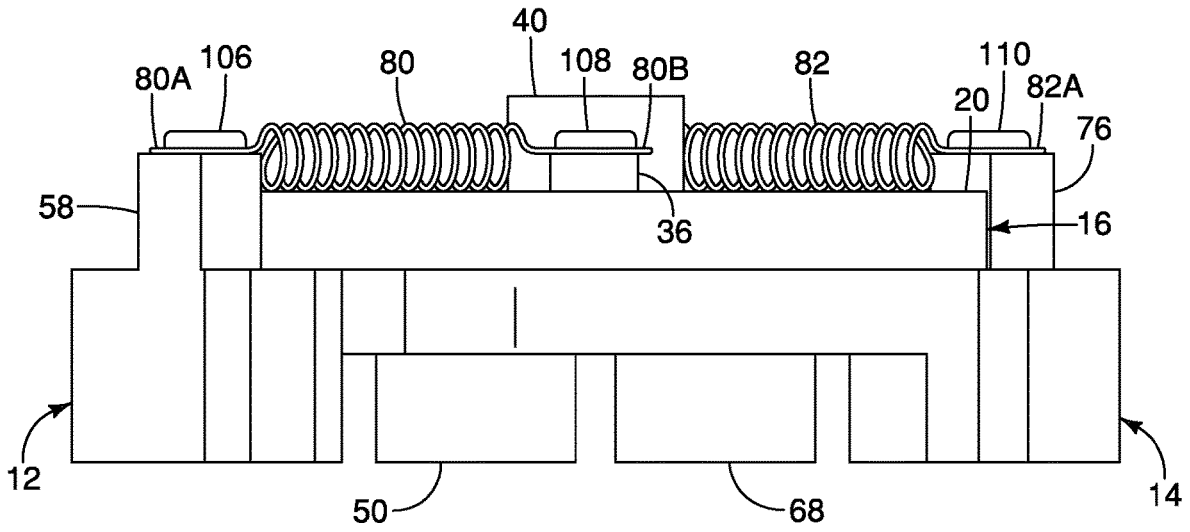
FIG. 9 is a side elevational view of the partially assembled socket tool adapter of FIG. 8.

As shown in FIG. 8, the second biasing member 82 is connected between the second jaw member 14 and the base member 16. A fastener 110 is received by the second fastener hole 78 in the second projection 76 of the second jaw member 14 to secure a first end 82A of the second biasing member 82 to the second jaw member 14. A fastener 112 is received by the fourth fastener receiving post 38 of the base member 16 to secure the second end 82B of the second biasing member 82 to the base member 16. As shown in FIG. 9, the first projection 58 of the first jaw member 12 and the second projection 76 of the second jaw member 14 extend beyond the second surface 20 of the base member 16.

The cover member 84 is then connected to the second surface 20 of the base member 16, as shown in FIG. 10. The first and second fastener receiving posts 90 and 92 of the cover member 84 are aligned with the third and fourth fastener holes 32 and 34 of the base member 16. The first surface 86 of the cover member 84 faces the second surface 20 of the base member 16. A fastener 114 is inserted from the second surface 88 of the cover member 84 through the first fastener receiving post 90 and the third fastener hole 32 of the base member 16 to secure the cover member 84 to the base member 16. A fastener 116 is inserted from the second surface 88 of the cover member 84 through the second receiving post 92 and the fourth fastener hole 34 of the base member 16 to secure the cover member 84 to the base member 16. A free end of the tool receiving projection 40 of the base member 16 is substantially flush with the second surface 88 of the cover member 84.

The socket tool adapter 10 is configured to receive an accessory, such as a bell cup for an automobile painting line, and to efficiently and properly install the accessory. The first and second jaw members 12 and 14 are pivotally connected to the base member 16 such that the first and second jaw members 12 and 14 can be opened to any suitable position to receive an accessory. The first jaw member 12 is biased to a first closed position, as shown in FIG. 1, by the first biasing member 80. The second jaw member 14 is biased to a second closed position, as shown in FIG. 1, by the second biasing member 82. As shown in FIG. 8, the first and second biasing members 80 and 82 are substantially parallel when the first and second jaw members 12 and 14 are in the first and second closed positions, respectively. The first jaw member 12 is configured to move between the first closed position to a first open position, as shown in FIG. 2. The second jaw member 14 is configured to move between the second closed position to a second open position, as shown in FIG. 2. The first and second jaw members 12 and 14 are configured to receive a first accessory A1 when the first and second jaw members are in the first and second open positions, respectively. The first and second open positions of the first and second jaw members 12 and 14 correspond to a size of the accessory to be received. As shown in FIG. 2, the first and second open positions of the first and second jaw members 12 and 14 can be configured to receive a 30 mm bell cup. The first accessory A1 is received by the first and third gripping members 50 and 68 of the first and second jaw members 12 and 14. The first and second biasing members 80 and 82 bias the first and second jaw members 12 and 14 to the first and second closed positions, respectively, such that the socket tool adapter 10 securely retains the received first accessory A1.

As shown in FIG. 3, the first and second jaw members 12 and 14 can be moved to third and fourth open positions, respectively, that are different than the first and second open positions to receive a second accessory A2 having a different size than the first accessory A1. The second accessory A2 is received by the second and fourth gripping members 52 and 70 of the first and second jaw members 12 and 14. The third and fourth open positions of the first and second jaw members 12 and 14 correspond to a different size of an accessory to be received. As shown in FIG. 3, the third and fourth open positions of the first and second jaw members 12 and 14 can be configured to receive an 80 mm bell cup. The first and second biasing members 80 and 82 bias the first and second jaw members 12 and 14 to the first and second closed positions, respectively, such that the socket tool adapter 10 securely retains the received second accessory A2.

As shown in FIGS. 2 and 3, the first and third gripping members 50 and 68 form a first gripping portion configured to receive the first accessory A1, and the second and fourth gripping members 52 and 70 form a second gripping portion configured to receive the second accessory A2. The second and fourth gripping members 50 and 68 are disposed farther from the tool receiving opening 26 in the base member 16 than the first and third gripping members 50 and 68. The first and second jaw members 12 and 14 have a larger pivotal rotation to the third and fourth open positions shown in FIG. 3 than the first and second open positions shown in FIG. 2, such that the first and second open positions of FIG. 2 are between the third and fourth open positions of FIG. 3 and the first and second closed positions of FIG. 1.

The first and second fastener receiving posts 22 and 24 of the base member 16 act as stop members when moving the first and second jaw members 12 and 14 to the open positions. The first and second jaw members 12 and 14 rotate about the pivotal connection when moving from the respective closed positions to an open position. As shown in FIGS. 2 and 3, the first and second jaw members 12 and 14 are moved in the counter-clockwise direction to an open position. The first and second gripping tabs 54 and 56 facilitate moving the first jaw member 12. The first and second gripping tabs 72 and 74 facilitate moving the second jaw member 14. The first and second fastener receiving posts 22 and 24 limit pivotal movement of the first and second jaw members in the counter-clockwise direction to prevent the first and second jaw members 12 and 14 from being opened too far.

When an accessory is received by the socket tool adapter 10, as shown in FIGS. 2 and 3, the first and second jaw members 12 and 14 are released such that the first and second biasing members 80 and 82 move the first and second jaw members 12 and 14 toward the closed positions such that the gripping members being used securely retain the received accessory. The gripping pads 104 facilitate retaining the received accessory while preventing damage to accessory. A tool, such as a split torque wrench, engages the tool receiving projection 40 through the tool receiving opening 90 in the cover member 84. The tool rotates the socket tool adapter 10 in the clockwise direction to install the accessory, as indicated by the arrows R in FIG. 10. The socket tool adapter 10 is rotated in a direction opposite to a biasing direction of the first and second biasing members 80 and 82 when installing the accessory. In other words, the socket tool adapter 10 is rotated in the clockwise direction during installation, and the first and second biasing members 80 and 82 bias the first and second jaw members 12 and 14 in the counter-clockwise direction. For example, a 1.0 Nm split torque wrench is used to install a 30 mm bell cup. Once 1.0 Nm of torque is achieved, the torque wrench will slip, thereby indicating that the bell cup is installed with the proper torque. As another example, a 3.5 Nm split torque wrench is used to install an 80 mm bell cup. Once 3.5 Nm of torque is achieved, the torque wrench will slip, thereby indicating that the bell cup is installed with the proper torque. Accordingly, the socket tool adapter 10 provides proper and efficient installation of the bell cup without over-tightening or otherwise damaging the bell cup.

Although the socket tool adapter 10 is described as including a tool receiving opening 90 in the cover member and a tool receiving projection 40 in the base member 16 to facilitate removably receiving a tool, the present invention is not so limited. Any other suitable means can be provided by which the socket tool adapter can be rigidly or permanently connected to a tool.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Also as used herein to describe the above embodiment (s), the following directional terms "forward", "rearward", "above", "downward", "vertical", "horizontal", "below" and "transverse" as well as any other similar directional terms refer to those directions of the socket tool adapter. Accordingly, these terms, as utilized to describe the present invention should be interpreted relative to a socket tool adapter.

The terms of degree such as "substantially", "about" and "approximately" as used herein mean a reasonable amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A socket, tool adapter, comprising:

a base member having a first surface and a second surface;

a first jaw member pivotally connected to the first surface of the base member, the first jaw member being configured to move between a first closed position and a first open position;

a second jaw member pivotally connected to the first surface of the base member, the second jaw member being configured to move between a second closed position and a second open position, the first and second jaw members being configured to receive an accessory when the first and second jaw members are in the open positions;

a first biasing member connected between the first jaw member and the base member, the first biasing member being configured to bias the first jaw member to the first closed position;

a second biasing member connected between the second jaw member and the base member, the second biasing member being configured to bias the second jaw member to the second closed position; and a cover member connected to the second surface of the base member.

2. The socket tool adapter according to claim 1, wherein a tool receiving opening disposed in the base member is configured to receive a tool.

3. The socket tool adapter according to claim 2, wherein first and second gripping members extend outwardly from the first jaw member, and third and fourth gripping members extend outwardly from the second jaw member, the first and third gripping members forming a first gripping portion configured to receive a first accessory and the second and fourth gripping members forming a second gripping portion configured to receive a second accessory.

4. The socket tool adapter according to claim 3, wherein the second and fourth gripping members are disposed farther from the tool receiving opening in the base member than the first and third gripping members.

5. The socket tool adapter according to claim 3, wherein a gripping pad is connected to each of the first, second, third and fourth gripping members.

6. The socket tool adapter according to claim 5, wherein, the gripping pads are made of a rubber material.

7. The socket tool adapter according to claim 2, wherein a third projection surrounds the tool receiving opening and extends outwardly from the second surface of the base member.

8. The socket tool adapter according to claim 7, wherein a free end of the third projection is substantially flush with an outer surface of the cover member.

9. The socket, tool adapter according to claim 2, wherein the socket tool adapter is configured to be rotated in a direction opposite to a biasing direction of the first and second biasing members when installing the accessory.

10. The socket tool adapter according to claim 1, wherein a first projection extends downwardly from the first jaw member and a second projection extends downwardly from the second jaw member, the first and second biasing members being connected to the first and second projections, respectively.

11. The socket tool adapter according to claim 10, wherein the first and second projections extend beyond the second surface of the base member.

12. The socket tool adapter according to claim 1, wherein the first and second biasing members are substantially parallel when the first and second jaw membeis are in the first and second closed positions, respectively.

13. The socket tool adapter according to claim 1, wherein first and second stop members extend outwardly from the first surface of the base member to limit movement of the first and second jaw members, respectively.

14. The socket tool adapter according to claim 13, wherein first and second fastener receiving holes extend through the first and second stop members, respectively, to the second surface of the base member, the first and second biasing members being connected to first and second fasteners received by the first and second fastener receiving holes, respectively.

15. The socket tool adapter according to claim 1, wherein the first and second open positions of the first and second jaw members corresponds to a size of the accessory.

16. A socket tool adapter, comprising:

a base member having a first surface and a second surface;

a tool receiving opening disposed in the base member configured to receive a tool;

a first jaw member pivotally connected to the first surface of the base member, the first jaw member being configured to move between a first closed position and a first open position, first and second gripping members extending outwardly from the first jaw member;

a second jaw member pivotally connected to the first surface of the base member, the second jaw member being configured to move between a second closed position and a second open position, third and fourth gripping members extending outwardly from the second jaw member;

a first biasing member connected between the first jaw member and the base member, the first biasing member being configured to bias the first jaw member to the first closed position;

a second biasing member connected between the second jaw member and the base member, the second biasing member being configured to bias the second jaw member to the second closed position; and a cover member connected to the second surface of the base member;

the first and third gripping members forming a first gripping portion configured to receive a first accessory when the first and second jaw members are moved to the first and second open positions, respectively, and the second and fourth gripping members forming a second gripping portion configured to receive a second accessory when the first and second jaw members are in a position between the first and second closed positions, and the first and second open positions, respectively.

17. The socket tool adapter according to claim 16, wherein a first projection extends downwardly from the first jaw member and a second projection extends downwardly from the second jaw member, the first and second biasing members being connected the first and second projections, respectively.

18. The socket tool adapter according to claim 17, wherein the first and second projections extend beyond the second surface of the base member.

19. The socket tool adapter according to claim 16, wherein a gripping pad is connected to each of the first, second, third and fourth gripping members.

20. The socket tool adapter according to claim 16, wherein the socket tool adaptor is configured to be rotated in a direction opposite to the biasing direction of the first and second biasing members when installing the first or second accessory.

* * * * *